United States Patent [19]

Nagel

[11] Patent Number: 4,463,867

[45] Date of Patent: Aug. 7, 1984

[54] PLASTIC CONTAINER WITH EASILY REMOVABLE, INTEGRALLY FORMED CAP

[75] Inventor: Dieter H. Nagel, Elk Grove Village, Ill.

[73] Assignee: Heinz Plastic Mold Co., Elk Grove Village, Ill.

[21] Appl. No.: 524,659

[22] Filed: Aug. 19, 1983

[51] Int. Cl.[3] ..... B65D 17/34

[52] U.S. Cl. ..... 220/270; 220/276; 215/1 C

[58] Field of Search ..... 220/266, 270, 276; 150/5; 215/1 C

[56] References Cited

U.S. PATENT DOCUMENTS

| | | | |
|---|---|---|---|
| 3,563,407 | 2/1971 | Wachter | 220/270 |
| 3,667,638 | 6/1972 | Cambio, Jr. | 215/1 C |
| 4,298,045 | 11/1981 | Weiler et al. | 215/1 C |

*Primary Examiner*—George T. Hall
*Attorney, Agent, or Firm*—Robert E. Knechtel

[57] ABSTRACT

A thermoplastic container which is blown, filled and hermetically sealed in a single forming and filling operation. The removable cap integrally formed therewith normally hermetically seals the container and has a peripheral side wall, a horizontal flange portion which merges with the neck portion and an annular groove which is formed in the horizontal flange portion and provides a weakened severing line for removing the cap. A pull tab having a narrow in width, vertically disposed tab flange is integrally connected with the horizontally extending flange portion and has means for gripping the pull tab to pivotally manipulate the pull tab outwardly from the container. The pull tab on being pivotally manipulated causes the horizontally extending flange portion to sever at the annular groove, thereby permitting the cap to be removed from the container.

10 Claims, 10 Drawing Figures

PLASTIC CONTAINER WITH EASILY REMOVABLE, INTEGRALLY FORMED CAP

BACKGROUND OF THE INVENTION

This invention relates to an improved blown plastic container formed with an easily removable, integrally formed cap.

May various different types of blown containers presently areavailable, however, most of them are hermetically sealed by means of an enclosure or cap which is removed by severing it with a knife or the like. Still others have threads integrally formed on a neck portion thereof, and a separate cap is provided for closing or sealing the bottle by threading the cap onto the threaded neck portion. All of these prior arrangements are satisfactory, for one purpose or another. Recently, however, a demand for bottles having integrally formed caps for sealing the bottles has occurred. In another words, a demand for a bottle which can be blown, filled and hermetically sealed with an enclosure of a type which can be easily removed. The improved container of the present invention satisfy this demand.

Accordingly, it is an object of this invention to provide new and improved containers which are blown, filled and are hermetically sealed having an easily removable, integrally formed cap.

In some cases, it is desirable to form these containers of a substantially strong plastic material which cannot be easily severed to remove the caps integrally formed therewith. Accordingly, still another object is to provide an improved container whereby such caps can be easily removed.

The above objectives are accomplished with the thermoplastic container of the present invention which is blown, filled and hermetically sealed in a single forming and filling operation. The removable cap integrally formed therewith normally hermetically seals the container and has a peripheral side wall, a horizontal flange portion which merges with the neck portion an an annular groove which is formed in the horizontal flange portion and provides a weakened severing line for removing the cap. A pull tab having a narrow in width, vertically disposed tab flange is integrally connected with the horizontally extending flange portion and has means for gripping the pull tab to pivotally manipulate the pull tab outwardly from the container. The pull tab on being pivotally manipulated causes the horizontally extending flange portion to sever at the annular groove, thereby permitting the cap to be removed from the container.

In accordance with the second embodiment of the invention, a second annular groove is formed in the horizontally extending flange portion in space relationship from the first annular groove. Both of the annular grooves provide weakened severing lines for removing the cap. The pull tab on being pivotally manipulated causes the horizontally flange portion to sever at each of the first and second annular grooves to provide an annular web therebetween which is severed from the horizontally extending flange portion, thereby permitting the cap to be removed from the container.

In the case of the container disclosed in the second embodiment of the invention, it is also preferred to provide a groove extending between the first and second annular grooves to provide a weakened severing line therebetween. The groove upon being severed when the pull tab is pivotally manipulated permits the pull tab to be pulled to sever the annular web in an annular fashion about the cap to permit the cap to be removed from the container.

For a fuller understanding of the nature and objects of the invention, reference should be had to the following detailed description taken in connection with the accompanying drawings.

DESCRIPTION OF THE INVENTION

Figure 1:
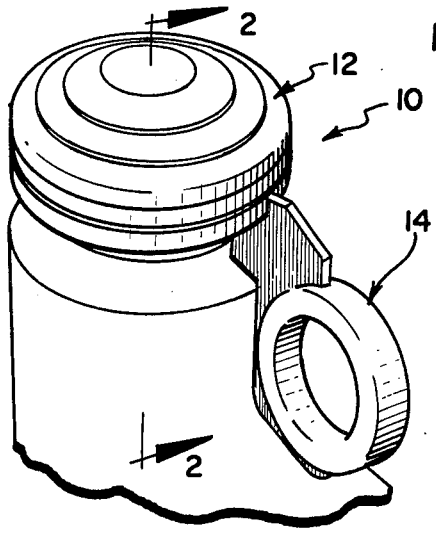
FIG. 1 is a partial respective view of a container exemplary of a first embodiment of the invention.

Referring now to the drawings, particularly FIGS. 1–4 thereof, there is illustrated a thermoplastic container 10 which is blown, filled and hermetically sealed in a single forming and filling operation. In this respect, the container 10 can be blown, filled and hermetically sealed in the manner disclosed in U.S. Pat. No. 3,325,860 to Gerhard Hansen. For a full and detailed description of the apparatus for blowing, filling and sealing the container, reference can be made to the above-mentioned U.S. Pat. No. 3,325,860. The container 10 includes a cap 12 which is integrally formed with the container and which hermetically seals the container. The container 10 can be of any desired size or shape hence the body portion of the container 10 is not shown. The container 10 also has a pull tab 14 integrally formed with the cap 12, as more particularly described below.

Figure 2:
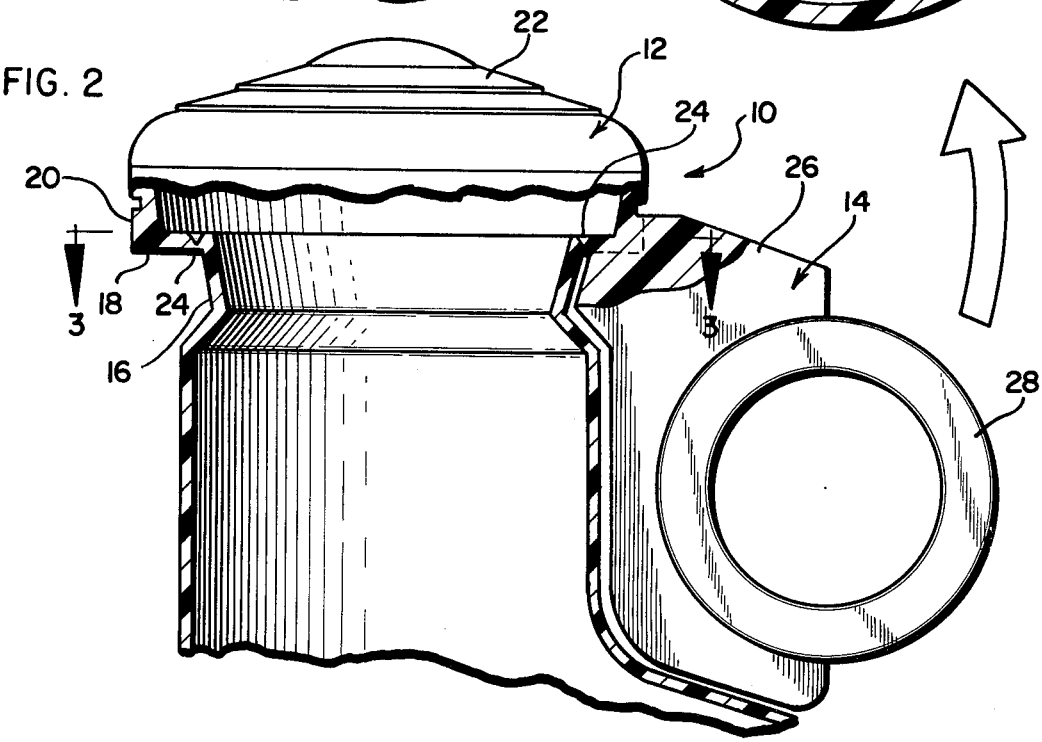
FIG 2 is a partial sectional view taken substantially along lines 2—2 of FIG. 1.

As can be best seen in FIG. 2, the container 10 has a neck portion 16 which extends substantially vertically and merges with a horizontally extending flange 18 of the cap 12. The cap 12 has a side wall 20 and a top cover or wall 22. As indicated above, the cap 12 is integrally formed with the container 10 during the blowing, filling and sealing operation, and hermetically seals the container 10. Interiorly of the container 10 or cap 12, there is formed a groove 24 which, in the illustrated embodiment, is an annular V-shaped groove, as can be best seen in FIG. 3. The V-shaped groove 24 provides a weakened severing line in the horizontally extending flange portion 18 of the cap 12, for removing the cap 12, as more particularly described below.

Figure 3:
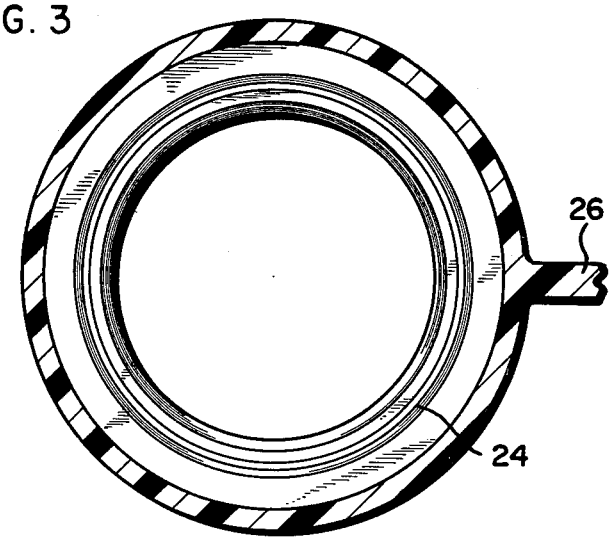
FIG. 3 is a sectional view taken substantially lines 3—3 of FIG. 2.

The pull tab 14 has a tab flange 26, which, as can be best seen in FIGS. 1 and 3, is narrow in width and is vertically disposed. The tab flange is integrally connected with the horizontally extending flange portion 18 of the cap 12, and extends from adjacent the V-shaped groove 24 outwardly to the peripheral side wall 20 of the cap 12 and at least partially integrally formed with the peripheral side wall 20. The pull tab 14 also has a finger ring 28 for receiving therein a finger for manually manipulating the pull tab 14 integrally formed with the tab flange 26 thereof.

Figure 4:
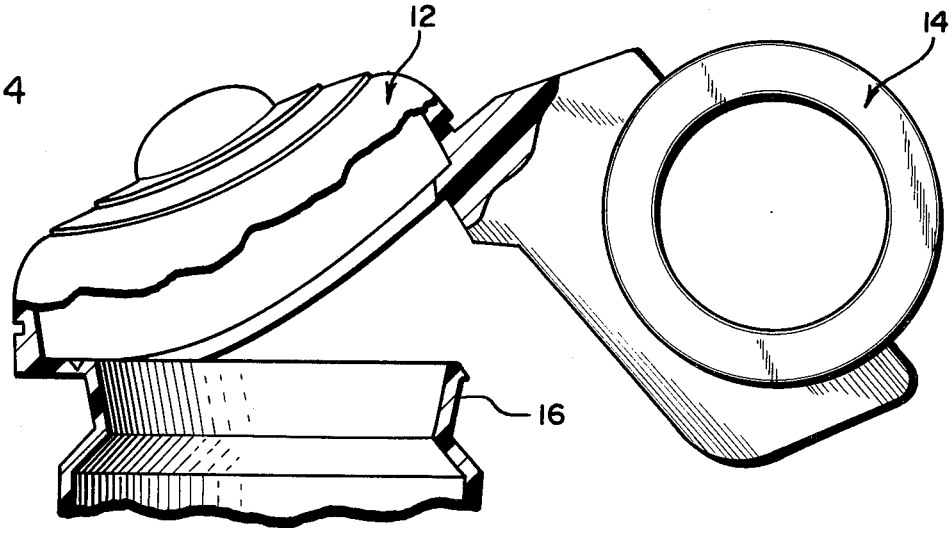
FIG. 4 is a partial sectional view generally illustrating the manner in which the cap is severed from the container.
Figure 5:
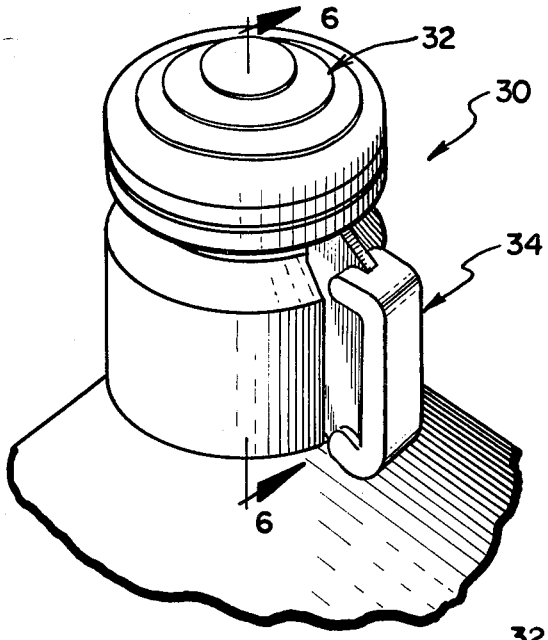
FIG. 5 is a partial perspective view of a container exemplary of a second embodiment of the invention.
Figure 6:
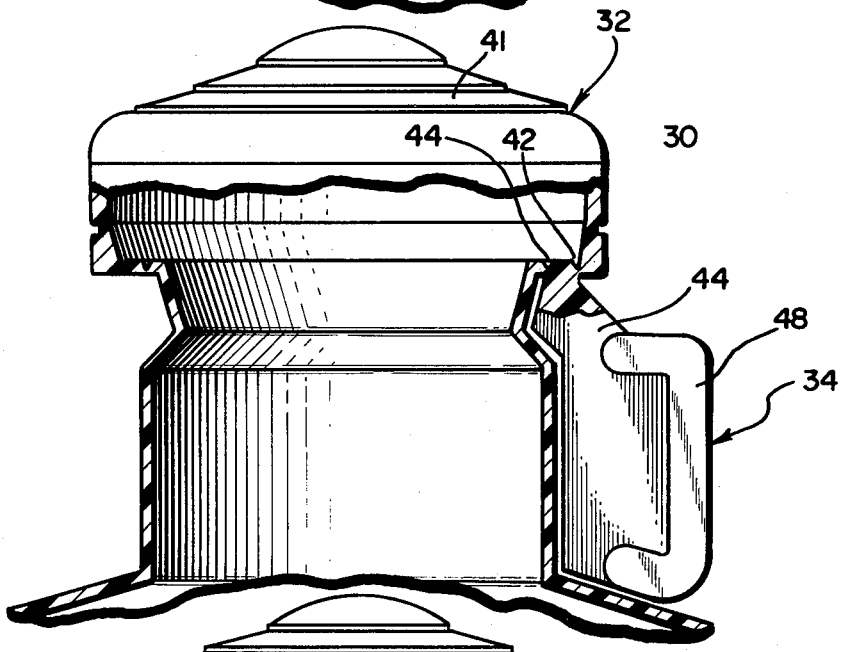
FIG. 6 is a partial sectional view taken substantially along lines 6—6 of FIG. 1.

To open the container 10 by removing the cap 12, the pull tab 14 is pivotally manipulated by means of a finger or the like inserted in the finger ring 28 outwardly from the container 10, as generally illustrated in FIG. 4. The pull tab 14 on being pivotally manipulated causes the horizontally extending flange portion 18 to sever at the V-shaped groove 24, as a result of the outwardly and downwardly force exerted on the horizontally flange 18 at the V-shaped groove 24. Initially, the V-shaped groove 24 will cause the horizontally extending flange 18 to sever in the area immediately adjacent to the tab flange 26, and as the pull tab 14 is forcibly manipulated outwardly and upwardly, severing of the V-shaped groove 24 annularly about the cap 12, as illustrated. As a manipulating force is continually asserted to the pull tab 14, the cap 12 will be severed from the container 10, as the V-shaped groove 24 is severed. In this fashion, the cap 12 can be easily severed from the container 10, to open it.

In FIGS. 5–10 there is illustrated a container 30 which is exemplary of a second embodiment of the invention. The container 30 is blown, formed and hermetically sealed in the same manner as described above, with respect to the container 10. In this case also, the container 30 can be of any size or shape, and the body portion thereof therefore is not shown. The container 30 includes a cap 32 which hermetically seals the container 30 and which has a horizontally extending flange 38, a peripheral side wall 40 and a top cover or wall 41. The horizontally extending flange 38 of the cap 32 merges and is integrally formed with the neck portion 36 of the container 30. The container 10 also has a pull tab 34 which includes a narrow in width tab flange 44 which is integrally connected with the horizontally extending flange portion 38 of the tab 32 and a finger grap 48. The tab flange 44 is narrow in width and is vertically disposed. In the above respects, the container 30 is substantially like the container 10.

Interiorly of the container 30, a first V-shaped groove 42 and a second V-shaped groove 44 are formed annularly about the horizontally extending flange 38. The V-shaped grooves 42 and 44 are in spaced apart relationship, for reasons set forth more specifically below.

Figure 7:
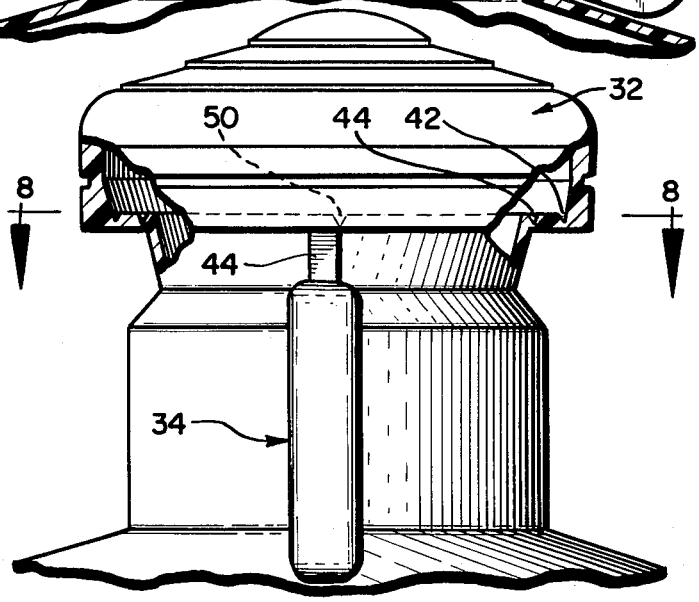
FIG. 7 is a partial side plan view of the container of FIG. 5 partially sectionalized to illustrate the annular grooves.
Figure 8:
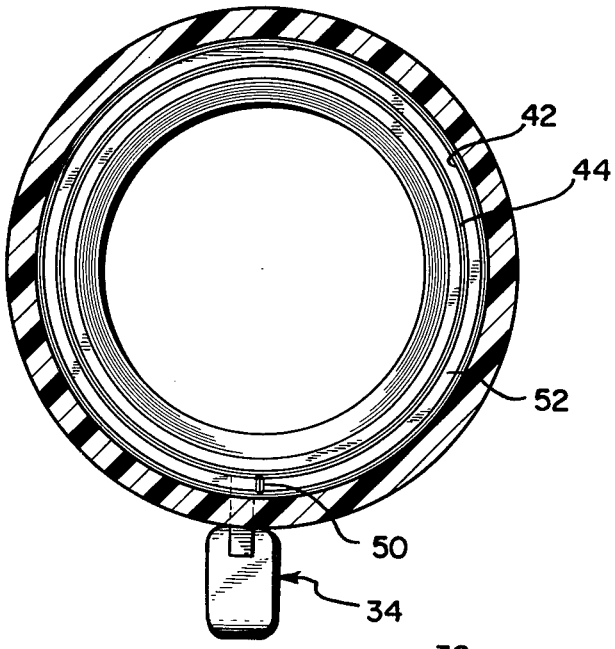
FIG. 8 is a sectional view taken substantially along lines 8—8 of FIG. 7.

Also, as can be best seen in FIGS. 7 and 8, a V-shaped groove 50 is formed interiorly of the container 10 and spans between the two V-shaped grooves 42 and 44.

Figure 9:
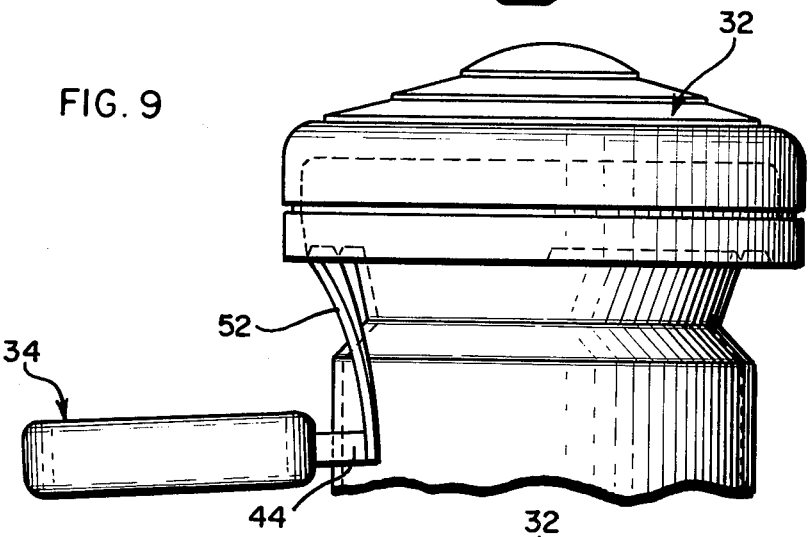
FIG. 9 is a partial side plan view generally illustrating the manner in which the web between the annular grooves is removed to remove the cap from the container.
Figure 10:
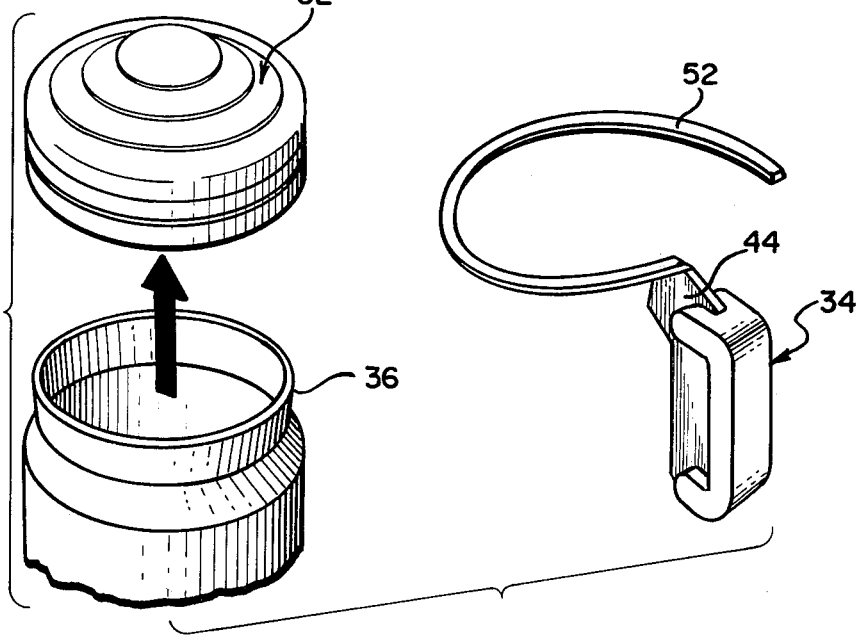
FIG. 10 is an exploded partial perspective view illustrating the manner in which the cap is severed from the container.

With the container 30, the cap 32 is removed therefrom in essentially the same fashion as the cap 12 is removed from the container 10. However, in this case, when the pull tab 34 is pivotally manipulated outwardly and upwardly, the V-shaped groove 50, since it is immediately adjacent the edge of one edge of the tab flange 44, as can be best seen in FIG. 7, is caused to sever. Once the V-shaped groove 50 is severed, the pull tab 34 is pulled downwardly, as generally illustrated in FIG. 9, to cause both of the V-shaped grooves 42 and 44 to sever from the horizontally extending flange 38. As can be best seen in FIGS. 9 and 10, as the two V-shaped grooves 42 and 44 are severed, a web 52 which comprises the material disposed between the two V-shaped grooves 42 and 44 is annularly peeled from the horizontally extending flange 38 and, when completely severed, frees the cap 32 from the container 30 as illustrated in FIG. 10. In this fashion, the cap 32 can be easily removed from the container 30, to open it.

Also, as indicated above, it is sometimes desirable to form the containers 10 and 30 of a substantially strong plastic material which cannot be easily severed to remove the caps integrally formed therewith. Accordingly, while it may be somewhat difficult to remove the cap 12 from the container 10, the web 52 is easily severed from the horizontally extending flange portion 38 of the cap 32 and the cap 32 therefore can be far more easily removed from the container 30.

What is claimed is:

1. A thermoplastic container which is blown, filled and hermetically sealed in a single forming and filling operation and which has a removable cap integrally formed therewith, said container comprising a neck portion, said removable cap normally hermetically sealing said container and having a peripheral side wall, a horizontally extending flange portion which merges with said neck portion, and a first annular groove formed in said horizontally extending flange portion and providing a weakened severing line for removing said cap, a pull tab having a narrow in width, vertically disposed tab flange integrally connected with said horizontally extending flange portion and extending from adjacent said first annular groove outward toward said peripheral side wall, and means for gripping said pull tab to pivotally manipulate said pull tab outwardly from said container, said pull tab on being pivotally manipulated causing said horizontally extending flange portion to sever at said first annular groove, thereby permitting said cap to be removed from said container.

2. The container of claim 1, wherein said first annular groove is formed interiorly in said container.

3. The container of claim 1, wherein said first annular groove is a V-shaped groove.

4. The container of claim 1, wherein said first annular groove is V-shaped groove and is formed interiorly in said container.

5. The container of claim 4, wherein said means for gripping said pull tab comprises a finger ring integrally formed with said tab flange.

6. The container of claim 4, wherein said tab flange extends from adjacent said first annular groove outwardly to said peripheral side wall and at least partially integrally formed with said peripheral side wall.

7. The container of claim 1, wherein said removable cap further comprises a second annular groove formed in said horizontally extending flange portion in spaced relationship from said first annular groove, said first and second annular grooves providing weakened severing lines for removing said cap, said tab flange being integrally connected with said horizontally extending flange portion and extending between said first and second annular grooves, said pull tab on being pivotally manipulated causing said horizontally extending flange portion to sever at each said first and second annular grooves to provide an annular web therebetween which is severed from said horizontally extending flange portion, thereby permitting said cap to be removed from said container.

8. The container of claim 7, further comprising a groove extending between said first and second annular grooves and providing a weakened severing line therebetween, said groove being severed when said pull tab is pivotally manipulated and permitting said pull tab to be pulled to sever said annular web in an annular fashion about said cap to thereby remove said cap from said container.

9. The container of claim 8, wherein said groove and said first and second annular grooves are formed interiorly in said container.

10. The container of claim 9, wherein said groove and said first and second annular grooves are V-shaped grooves.

* * * * *